US005960972A

United States Patent [19]

Larguia, Sr.

[11] Patent Number: 5,960,972

[45] **Date of Patent: *Oct. 5, 1999**

[54] CONTAINER CAP WITH INTERLOCKED SAFETY CLOSURE

[75] Inventor: Constancio Larguia, Sr., Cerrito 1070, Buenos Aires 1010, Argentina

[73] Assignee: Constancio Larguia, Sr., Buenos Aires, Argentina

[ * ] Notice: This patent is subject to a terminal disclaimer.

[21] Appl. No.: 08/749,690

[22] Filed: Nov. 15, 1996

[51] Int. Cl.[6] ..... B65D 45/30

[52] U.S. Cl. ..... 215/274; 215/253; 215/272; 215/322

[58] Field of Search ..... 215/201, 204, 215/224, 230, 253.25, 272, 274, 277, 279, 307, 317, 322, 341, 346, 349, 252; 206/459.1; 220/255, 256, 257, 265, 266

[56] References Cited

U.S. PATENT DOCUMENTS

| | | | |
|---|---|---|---|
| 1,862,620 | 6/1932 | Graham | 215/274 |
| 2,045,480 | 6/1936 | Magnesen et al. | 215/274 X |
| 2,659,511 | 11/1953 | Rice | 215/274 |
| 3,156,369 | 11/1964 | Bowes et al. | 215/250 X |
| 3,193,128 | 7/1965 | Ravn | 215/250 |
| 3,401,819 | 9/1968 | Salamone | 220/266 X |
| 3,893,582 | 7/1975 | Kowalik | 215/274 X |
| 4,279,353 | 7/1981 | Honma | 215/274 X |
| 4,747,497 | 5/1988 | Holman | 215/230 |
| 5,148,931 | 9/1992 | Minh | 215/230 X |
| 5,209,362 | 5/1993 | Lutzker | 215/274 X |
| 5,314,084 | 5/1994 | Folta et al. | 215/274 X |
| 5,316,163 | 5/1994 | Von Schuckmann | 215/274 X |
| 5,615,788 | 4/1997 | Larguia | 215/272 X |
| 5,813,554 | 9/1998 | Marangoni Graziani et al. | 215/274 |

*Primary Examiner*—Allan N. Shoap
*Assistant Examiner*—Robin A. Hylton
*Attorney, Agent, or Firm*—Evenson, McKeown, Edwards & Lenahan, PLLC

[57] ABSTRACT

The combination of a cap and a container. The cap is provided with an internal structure and an external structure movable with respect to one another among closed, intermediate and open cap positions. A plurality of hooks is provided on the internal structure for grasping a bead on the container when the cap is in the closed and intermediate cap positions. Ribs, disposed on the external structure, include upper extremities which prevent the cap from being placed directly from the closed cap position into the open cap position. Pressure relief of the container, if any, occurs in the intermediate cap position. The external structure of the cap defines a safety seal for indicating that the cap has been moved from the closed position.

14 Claims, 10 Drawing Sheets

CONTAINER CAP WITH INTERLOCKED SAFETY CLOSURE

CROSS-REFERENCE TO RELATED APPLICATION

This invention is related to the subject matter of U.S. patent application No. 08/513,508, filed Aug. 10, 1995, now U.S. Pat. No. 5,615,788.

BACKGROUND OF THE INVENTION

1. Field of the Invention

The present invention relates to a novel safety closure or cap for sealing a bottle or other container in which liquid, granular material, particulate material or any other material including solids is contained and to the combination of a container sealed by the novel cap or closure.

2. Description of Related Art

The application referred to above is directed to a top or cap for a container which includes a pressure adhesive paper seal disposed over exterior and interior parts of the cap for the purpose of indicating whether or not the container has been opened or tampered with. Upon rotation or longitudinal movement of the exterior part of the cap relative to the interior part of the cap, a perforated section of the paper seal is ruptured. A reliable indication that the container has been opened and that the contents of the container may have been tampered with is provided when the perforated section of the paper seal has been broken.

SUMMARY OF THE INVENTION

It is a primary object of this invention to provide a novel cap or closure for a container and a combined container and closure which functions in a more efficacious and efficient manner to hermetically seal the container and give evidence whether it has been opened or tampered with.

The above object, and others, are accomplished by the invention in which a closure for a container is made of an internal structure and an external structure which cooperate to effect the hermetic sealing of the container in a unique way. Unsealing of the container includes an intermediate cap position in which relief of any pressure or vacuum in the container is effected before the closure is fully opened and free of the container.

A novel tamper proof safety seal is defined by the inventive closure which gives clear visual and tactile evidence that the cap has been moved from the closed position to the intermediate position or to the opened position or has been tampered with.

DESCRIPTION OF THE PREFERRED EMBODIMENTS

Figure 1:
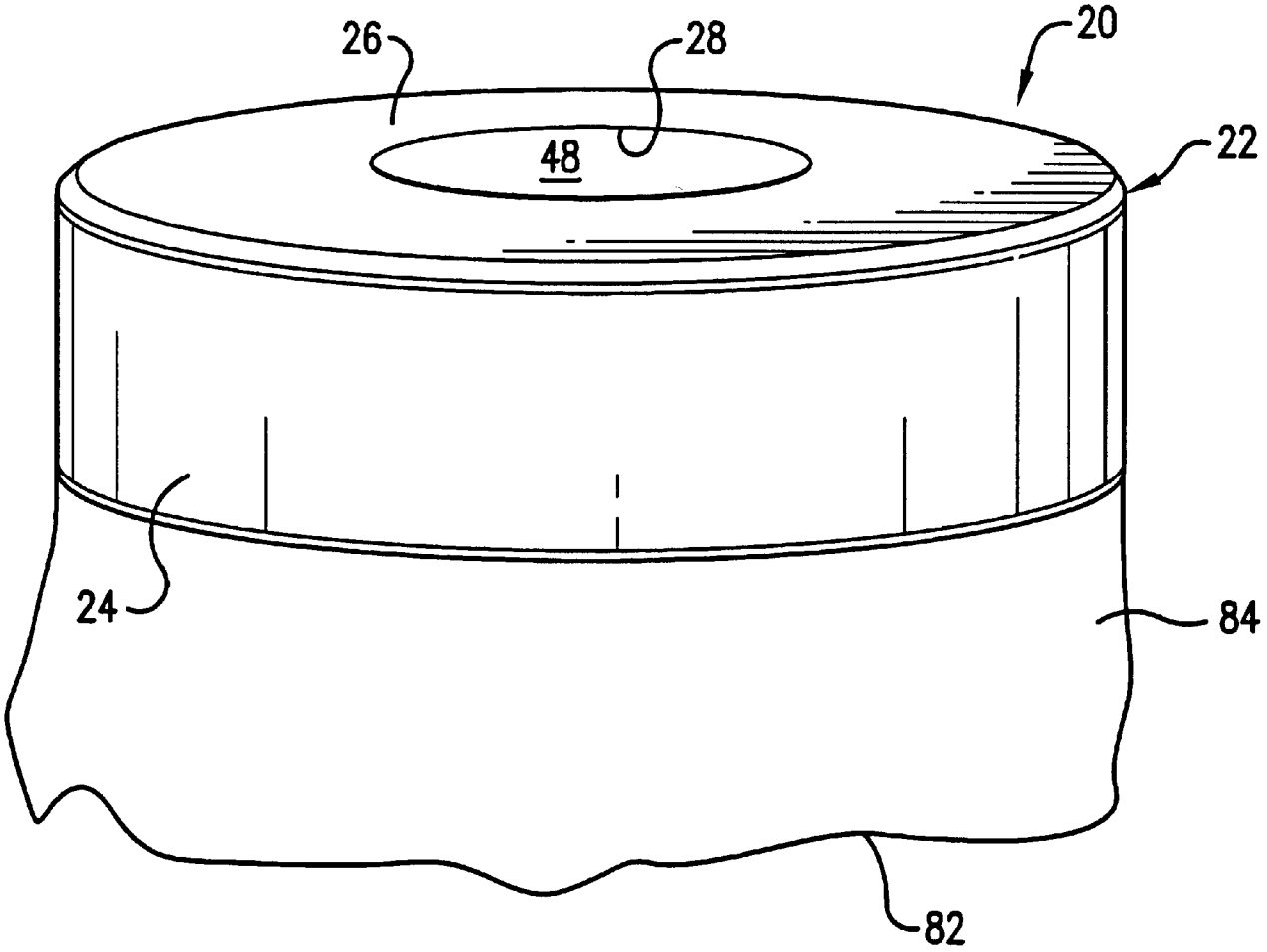
FIG. 1 is a perspective view of the novel closure or cap according to the present invention clamped in place over the mouth of a bottle.
Figure 2:
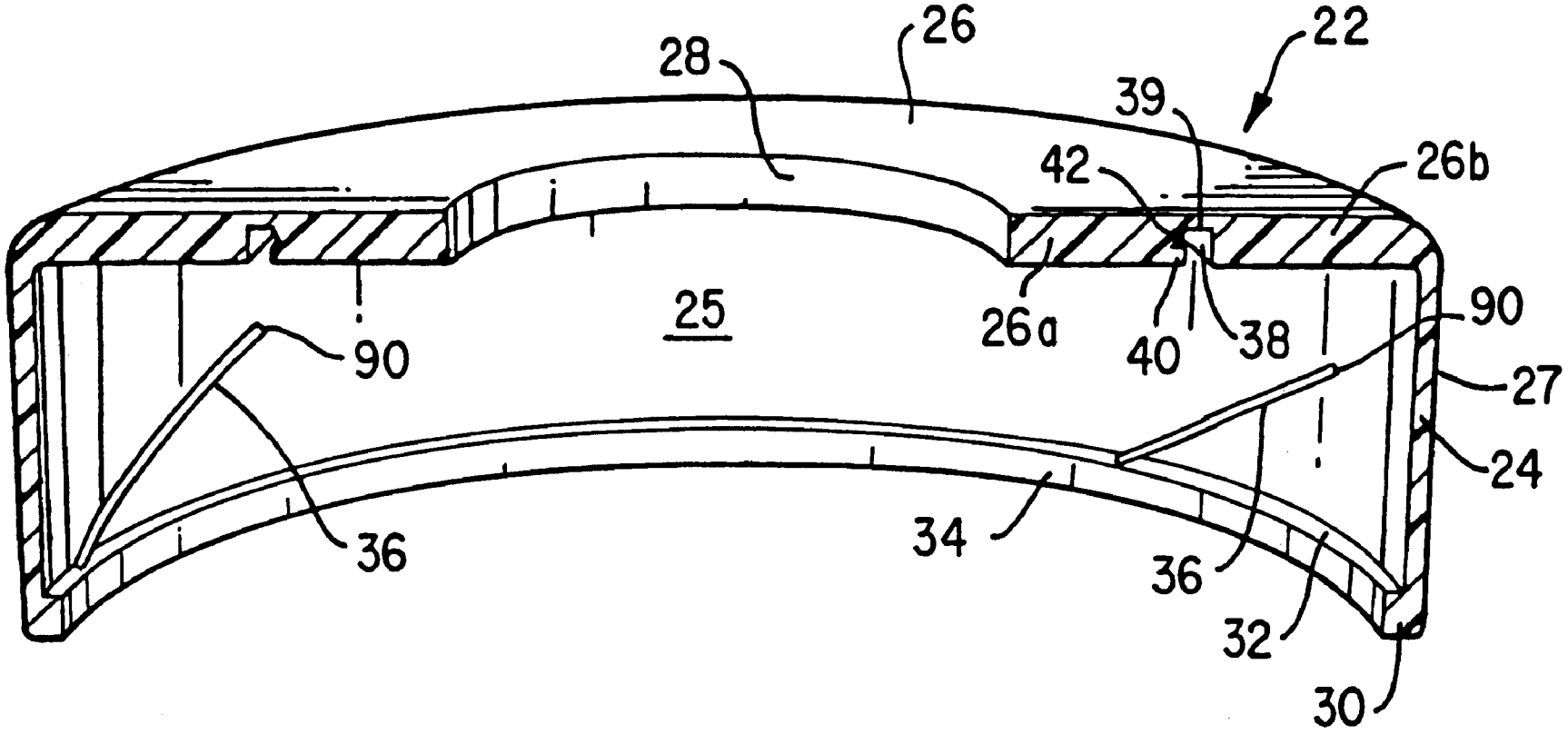
FIG. 2 is a sectional view of the external structure forming the outer portion of the closure or cap shown in FIG. 1.

FIG. 1 shows a cap 20 clamped to the neck 84 of a beverage bottle containing a liquid under pressure due to carbonation. The cap 20 hermetically seals the mouth of bottle 82. The cap 20 includes an external structure or portion 22 and an internal structure or portion 48. As known in the art, appropriate plastic materials can be selected and used to make both the external cap portion 22 and the internal cap portion 48 according to the functions described herein, both parts being made by injection molding. Referring to FIG. 2, the external structure 22 consists of an annular body having a cylindrical side wall 24 with approximately cylindrical inner 25 and outer 27 surfaces. A flat annular top 26 is joined to or integral with the top edge of side wall 24. A central opening 28 is formed in the flat annular top 26. Radially inwardly extending flange 30, illustrated in FIG. 2, is formed at the bottom or lower edge of side wall 24. The flange 30 forms a step or shoulder 32 which extends circumferentially around the opening defined by the lower edge of the side wall 24. The flange 30 includes the upper shoulder surface 32 and side surface 34. A plurality of internal ribs 36 are defined on and circumferentially spaced about the cylindrical inner surface 25 of the side wall 24. Each rib 36 extends obliquely or helically along the side wall cylindrical inner surface 25, starting at shoulder 32 and terminates at point 90 spaced from and below the top edge of side wall 24, a predetermined distance below or clearance from the underside of the flat annular top 26. Shorter ribs 36 may be used that start at the predetermined clearance from the underside of annular top 26 and extend downwardly toward the flange 30 but terminate short of reaching it.

The flat annular top 26 consists of two concentric annular parts 26*a* and 26*b* which are separated by an annular groove 38, but connected by a thin annular joint section 39. The groove 38 is configured such that a radially outwardly extending lip or flange 40 is formed on the lower edge of outer rim of inner annular part 26*a*. The lip or flange 40 defines, as part of the groove 38, a radially inwardly extending locking recess 42.

Figure 3:
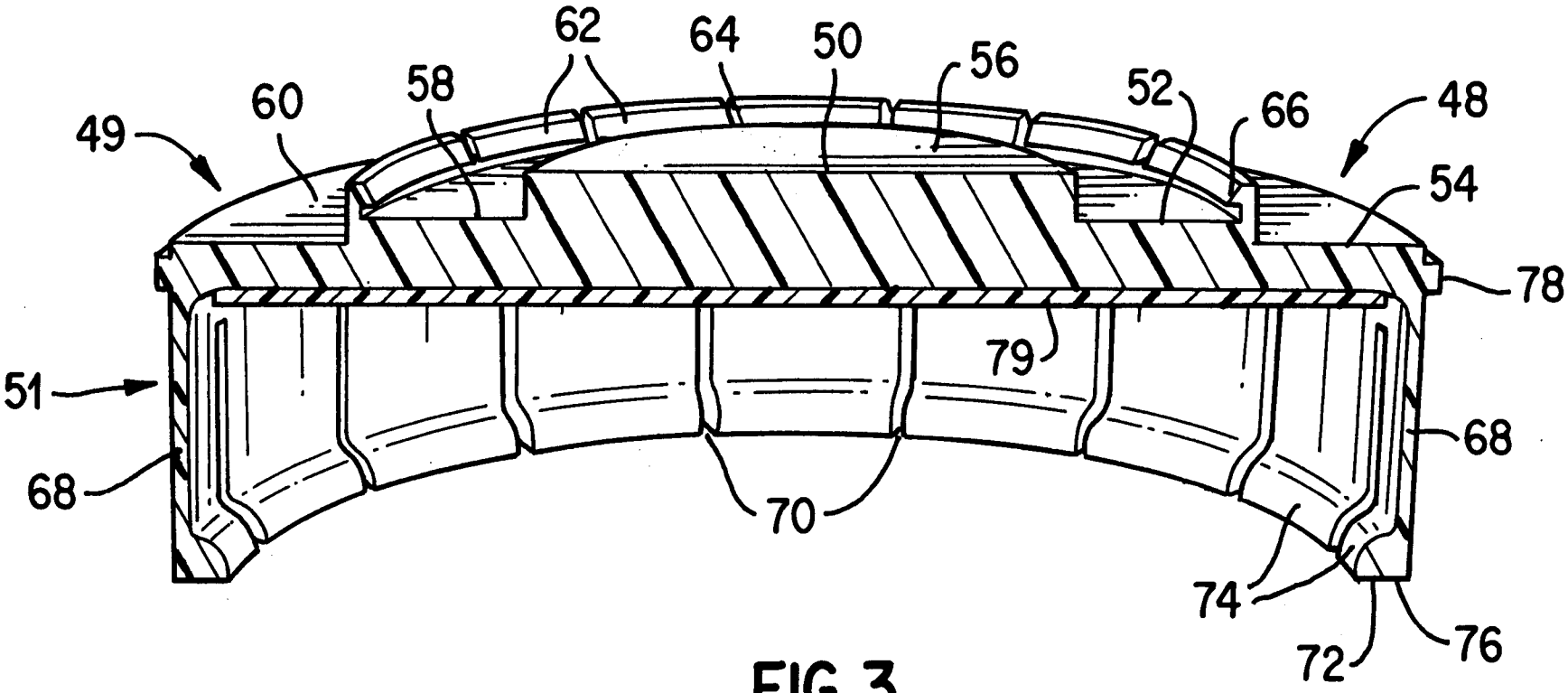
FIG. 3 is a sectional view of the internal structure forming the inner portion of the closure or cap shown in FIG. 1.

The one-piece internal portion 48 of the cap 20 is best shown in FIG. 3 and consists of a disc-like body 49 with an outer depending annular skirt. 51. Disc-like body 49 has a central cylindrical raised portion 50, an intermediate annular portion 52 surrounding the cylindrical raised portion 50 and an outer annular portion 54 surrounding the intermediate annular portion 52. The portions 50, 52 and 54 together form the disc-like body 49. The cylindrical raised portion 50 defines a first top surface 56. Second and third top surfaces 58 and 60 are defined by the intermediate and outer annular portions 52 and 54, respectively. Shoulders or steps are defined between the portions 50, 52 and 54. Upstanding arcuate flanges 62, having regularly spaced slots 64 defined therebetween, separate the second top surface 58 from the third top surface 60. Each flange 62 defines a radially inward detent or hook 66. The flanges 62 are joined in common at their lower edges.

Figure 4:
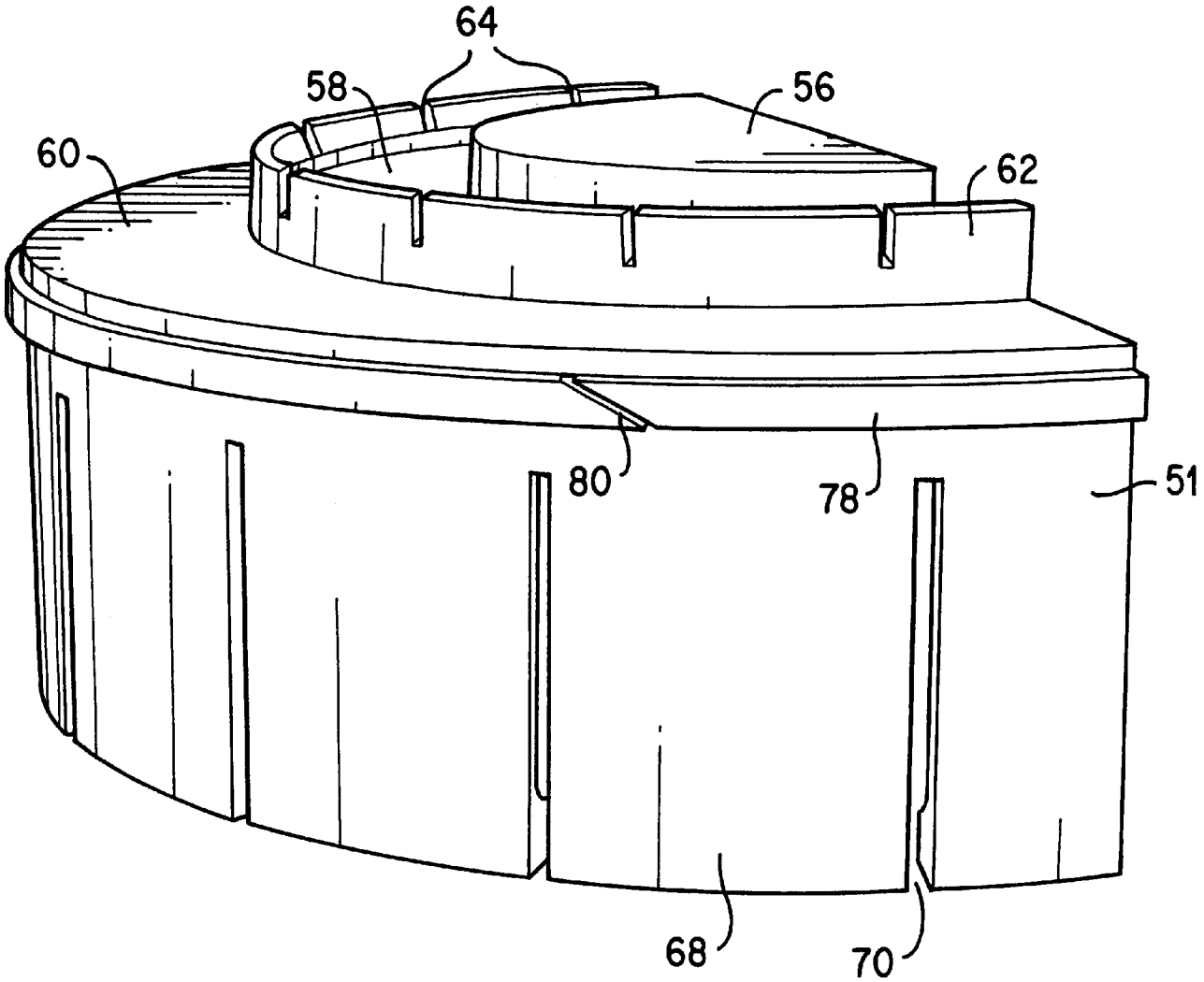
FIG. 4 is an enlarged partial view of the internal structure shown in FIG. 3.

The depending skirt 51 which extends downwardly from the outer rim of body 49 consists of a plurality of binding segments 68. Each of the binding segments 68 is separated from adjacent segments by slots 70. Lower ends of the binding segments 68 are radially enlarged or flanged to define inwardly extending hooks or clamping surfaces 72. The hooks 72 have convex contoured inwardly facing lateral clamping surfaces 74 and flat undersides 76. Segments 68 are joined in common at their upper edges or ends where they join body 49. An exterior flange 78 is defined on and extends radially outwardly and circumferentially around the outside of the disc-like body 49. A membrane liner 79 of an appropriate plastic or laminated material including a barrier layer is secured to the underside of the disc-like body 49 within the depending skirt 51 and serves to effect an hermetic seal on the mouth of the container to which the closure is capped. outwardly opening helical or oblique channels 80, corresponding in orientation, number and spacing to the ribs 36 defined on the external portion 22, are cut or otherwise formed in the exterior flange 78. The configuration of these channels 80 is apparent from FIG. 4. The number of channels 80 may be greater than the number of ribs 36. Also, the lower ends of or entry into channels 80 may be flared outwardly.

Figure 5:
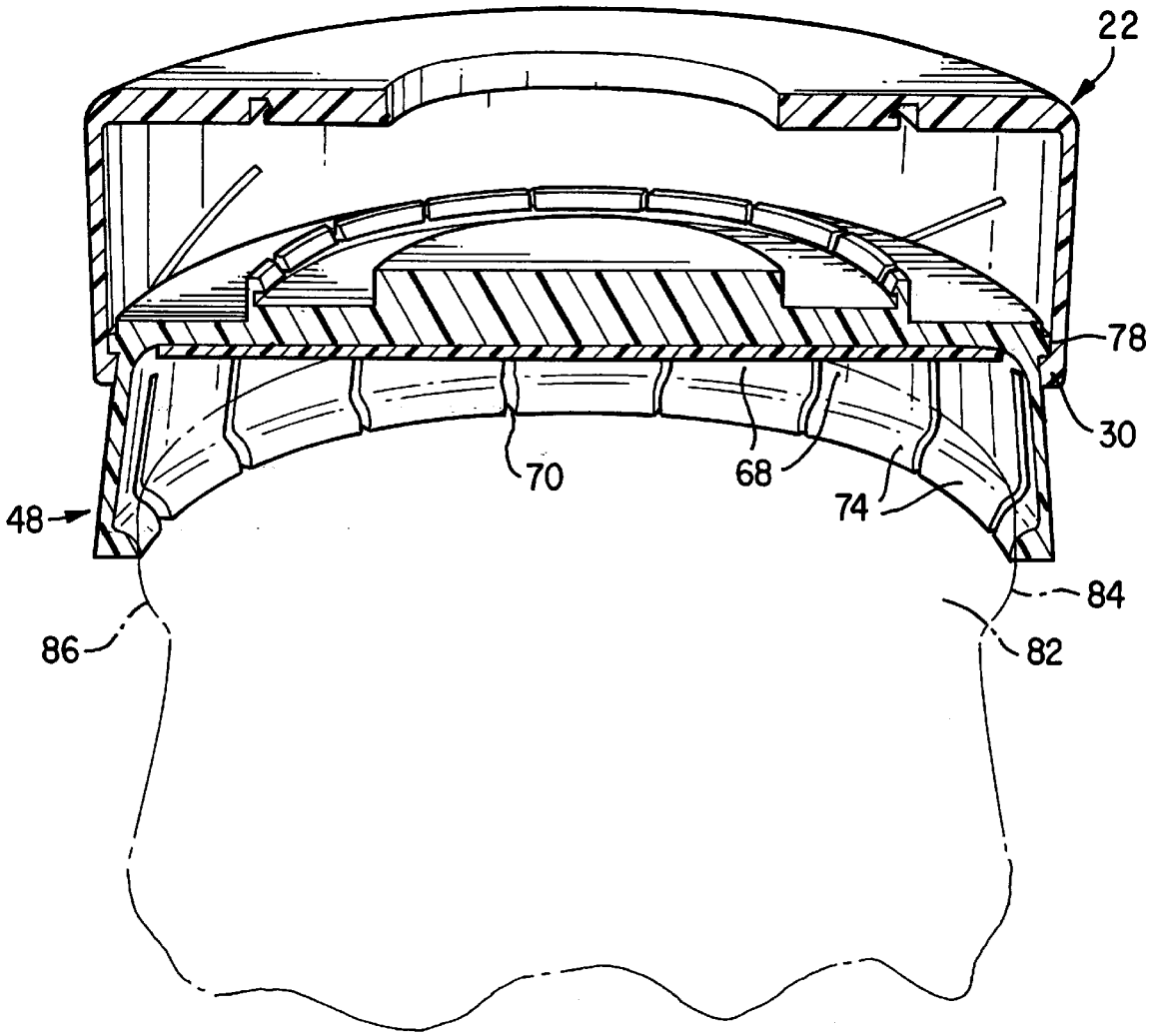
FIG. 5 is a sectional view showing the cap in an insertion or mounting position when it is to close and seal a bottle.
Figure 5A:
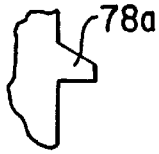
FIG. 5*a* is a partial view showing a modification.
Figure 5B:
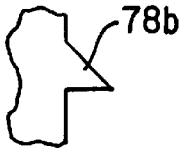
FIG. 5*b* is a partial view showing another modification.
Figure 5C:
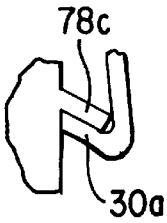
FIG. 5*c* is a partial view showing another modification.

An assembled cap is illustrated in FIG. 5. The internal and external cap portions 22, 48 can be coupled together preparatory to being clamped onto a container. For example, the outer structure 22 can be initially fabricated in two halves which can then be secured together adhesively or by heat sealing to be in the position and relationship relative to the inner structure as shown in FIG. 5 and, then, placed over the mouth of container 82 about its neck 84 preparatory to clamping. The outer structure 22 could also be a single body. The container neck 84 is provided with a radially inward downward sloping surface 86 (part of a bead) which cooperates with arcuate surface 74 of flange 72 to effect the clamping and produce the requisite downward force for sealing. Preferably, one or both of the flanges 30 and 78 is sufficiently flexible to permit coaxial insertion of the internal cap portion 48 into the external cap portion 22 during applying the closure to the container in one continuous downward movement. To this end, flange 78 may be trapezoidal in cross section as shown by 78*a* in FIG. 5*a*, triangular in cross section as shown by 78*b* in FIG. 5*b* or flanges 78 and 30 may both be inclined as shown by 30*a* and 78*c* in FIG. 5*c*. Also, the structures 22 and 48 can be temporarily held together by being pinned or a light tack (adhesive or heat) with flange 30 just above flange 78 so the two parts 22 and 48 can be machined handled as a unit and placed over the mouth of a container preparatory to making a closure, like the relationship shown in FIG. 5. In this way, a single downward force would first break the temporary holding, then couple the parts 22 and 48 by bringing flange 30 below flange 78 and, finally, then drive the parts 22 and 48 to the closed position as shown in FIG. 6.

The cap in FIG. 5 is shown with parts 22 and 48 coupled and in the insertion or mounting position. When the external portion 22 and the internal portion 48 are positioned as shown in FIG. 5, the binding segments 68 are normally biased outwardly at a slight angle to allow the lateral surfaces 74 to pass over the outside of the mouth of bottle 82, with or without some outward flexing or elastic deformation. Segments 68 can depend vertically if desired.

Once the assembled cap has been placed over the mouth of the bottle 82, the external portion 22 is moved downward relative to the internal portion 48. In this way, the cap progresses from the mounting position shown in FIG. 5 to the closed or sealed position shown in FIG. 6. This progression requires an initial twisting and vertical downward movement to pass the ribs 36 through the channels 80, and, once ribs 36 are free of channels 80, a subsequent movement in a downward vertical direction. As the external portion 22 approaches the end of this subsequent vertical movement, the flange 40 will ride along inclined surfaces of the detents 66 of arcuate flanges 62 causing detents 66 to be flexed outwardly. Continued vertical pressure on the external portion 22 causes the flanges 62 to be fully received in groove 38 and detents or hooks 66 clamped into the locking recess 42 of groove 38 behind flange 40. The internal and external portions of the cap 20 are joined or coupled by bottling machinery in this way. Once the detents 66 have passed by the lip or flange 40, the detents 66 act as hooks cooperating with the flange 40. This latching cooperation occurs after the detents 66 have enough room or space so that each flange 62 can spring back into its natural position. The necessary room or space is provided by the locking recess 42 of the groove 38.

Figure 6:
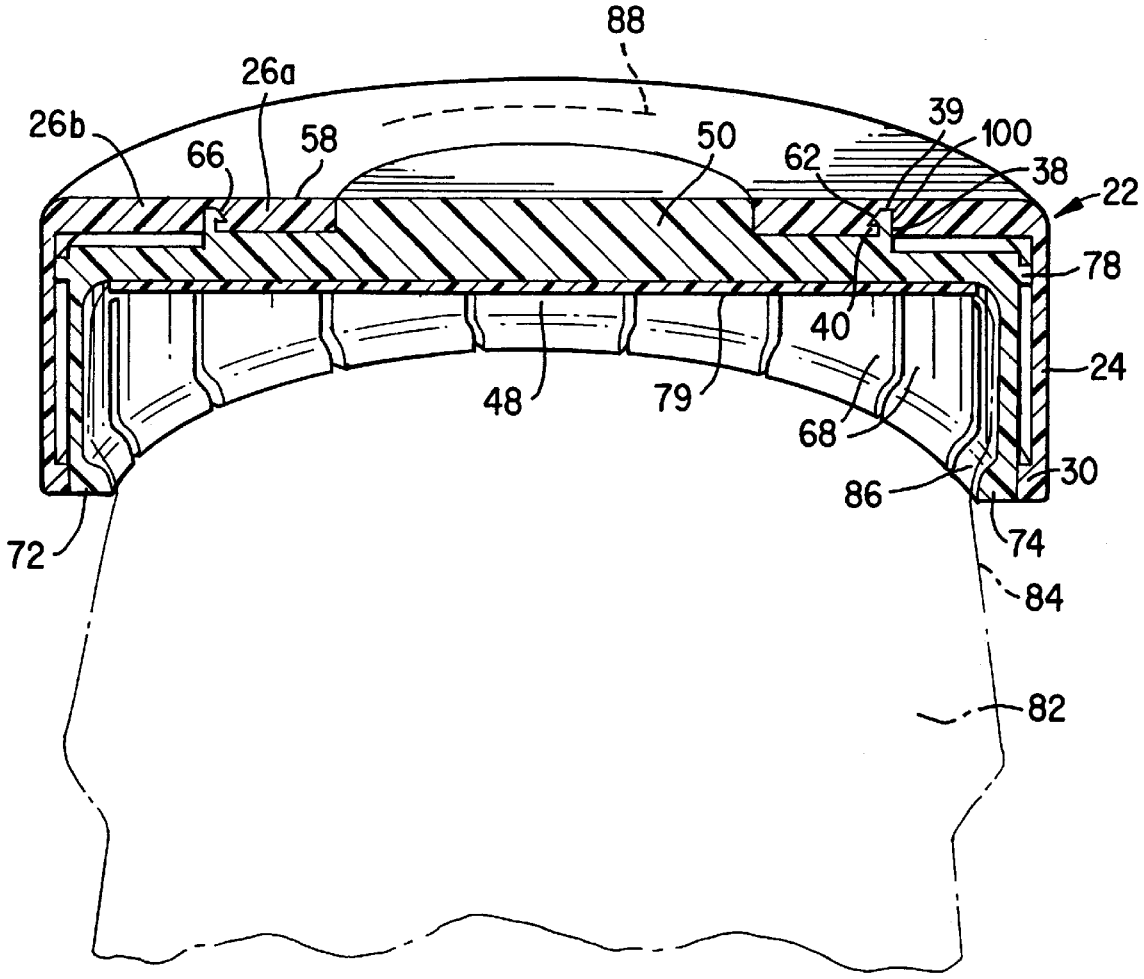
FIG. 6 is a view similar to FIG. 5 but showing the cap in the closed sealing position on the bottle.

FIG. 6 shows the assembled cap in the closed position and after placement over and attachment to the mouth of bottle 82. The central opening 28 in the top 26 receives the cylindrical raised portion 50 of the internal cap portion in a coplanar relation. The membrane liner 79 is in hermetically sealing contact with the mouth of the bottle 82 on account of flange 30 pressing arcuate surfaces 74 against the downward inclined surface 86 on the bead formed on the neck 84 of bottle 82 drawing the cap down on bottle 82. The detents 66 of the upstanding flanges 62 are complementary in size and form with that portion of the annular groove 38 defining the locking recess 42. An annular radially outer space 100 is defined between the flanges 62 and radially outer surface of groove 38. A boundary between the exterior annular part 26*b* and the interior annular part 26*a* is defined by the groove 38 and the thin joining section 39.

In the closed and sealed position, the detents 66 hook over the lip of flange 40 so that the flat annular top 26 is coplanar with raised portion 50 to form a tamper proof safety seal. The only way to remove the cap from the container, at this point, is by breaking the flat annular top 26 along a breach line 88 which generally overlies space 100. After the initial closing and sealing of the closure onto the mouth of the bottle, as described, breach or fracture line 88 must be breached or fractured or broken to allow the outer structure 22 to be moved axially relative to inner structure 48. The thin annular joint section 39 includes the breach line 88. If the breach line 88 is a scoring in section 39 and the weakening is sufficient, upon relative axial, i.e. vertical, movement of the external and internal portions 22 and 48, the breach line 88 can be broken, breached or fractured by the shear force, and the structures 22 and 48 can be pulled apart to the position shown in FIG. 7. However, it is preferred that breach line 88 is defined by a circle of perforations and that breaching or fracturing occurs by rotating structure 22 relative to structure 48, in either direction. Once annular sections 26*a* and 26*b* have been parted, structure 22 can be moved axially relative to structure 48. The break in the safety seal is readily visible.

The annular part 26*a* is clipped between the cylindrical raised portion 50, the second top surface 58 and the flanges 62 when the cap is in its closed and sealed position. Horizontal sliding is prevented by the raised portion 50. Vertical sliding is prevented by the clipping or latching action between the flanges 62 and the lip or flange 40. Arrangements such as, for example, one or more short pins extending from one structure and plugged into slots of the other structure could be used to prevent rotary movement. These pins can be used to secure the annular part 26*a* with the annular portion 52 to prevent rotation of the annular part 26*a* when the annular part 26*b* rotates. This helps the breach line to break. The clipping capacity provided by the detents 66 and the flange 40 is important because the use of adhesives between the internal and external portions 22 and 48 of the cap 20 can be avoided.

Figure 7:
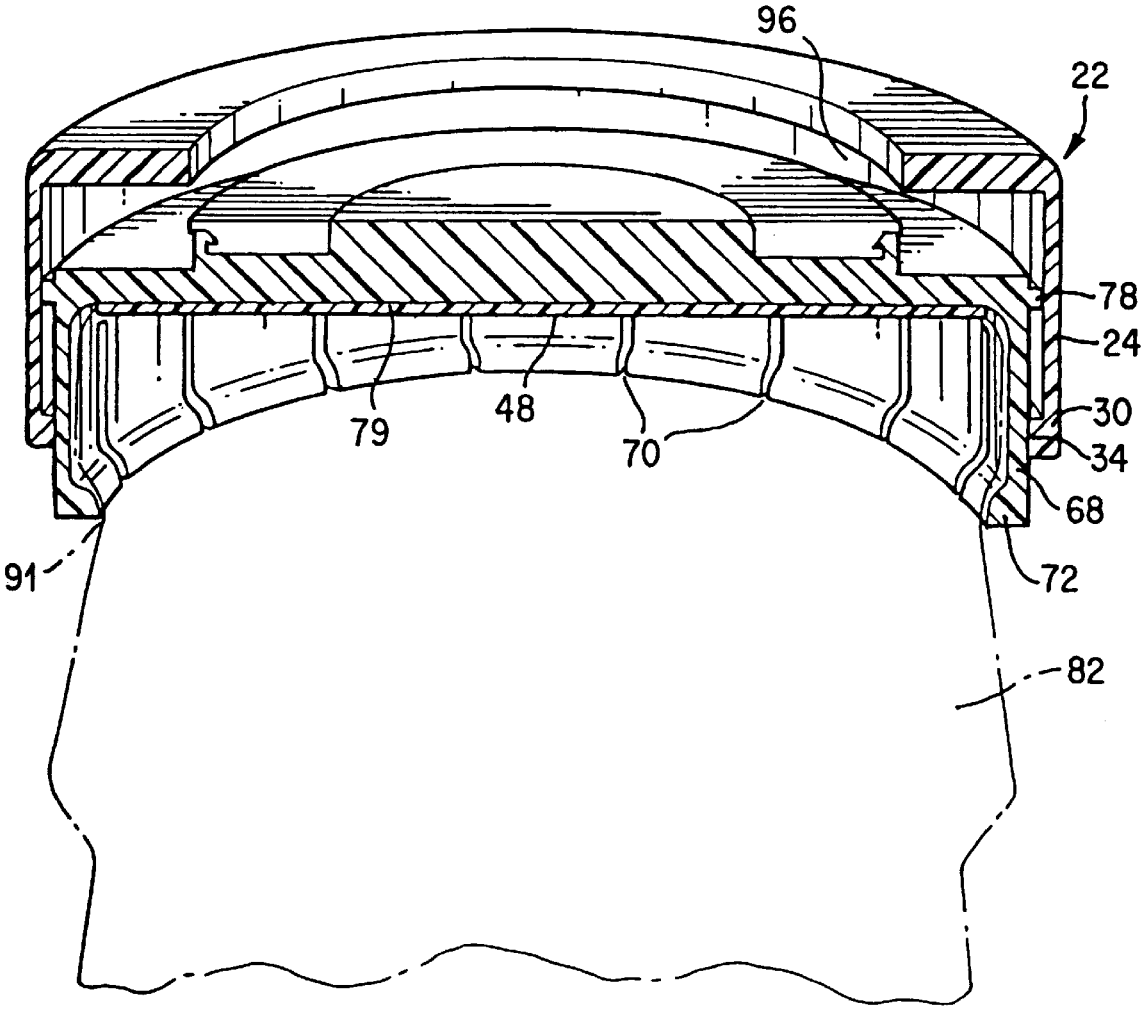
FIG. 7 is a view similar to FIG. 5 but showing the cap in an intermediate pressure relieving position with the safety seal broken.

A comparison of FIGS. 6 and 7 shows the manner in which the external portion 22 is vertically moved after the break of the safety seal. From the closed position shown in FIG. 6, the external portion 22 can be pulled and slid axially upwardly to a set limit. The top 26 of the external portion 22 is broken along the breach line 88. The only parts in frictional contact, at this point, are the flange side surface 34 with the exterior walls of segments 68 and the flange 78 with the upper portion of the cylindrical inner surface of the side wall 24. Opening movement of the external portion 22 in a vertical direction from the position shown in FIG. 6 can take place only until the top extremes 90 of the ribs 36 reaches the underside of the flange 78, at which point the outer structure 22 is blocked from further upward movement. Vertical axial sliding of the external portion 22 will then be stopped.

Free sliding of the external structure cannot go beyond the intermediate position shown in FIG. 7 because of the contact between the upper or top extremes or ends 90 of the ribs 36 and the underside of the flange 78. This is the case even if the extremes 90 coincide with the entrances of the channels 80 in the exterior flange 78 of internal portion 48. In this intermediate position, the flange 30 still exerts sufficient force on the segments 68 to maintain engagement of the hooks 72 with the downward inclined surface 86 on the bead formed on the neck of the bottle 82. However, the force on the segments 68 has also been sufficiently diminished to allow partial flexing to relieve any pressure or vacuum in bottle 82. It is not possible to remove the cap in the intermediate position shown in FIG. 7 because the hooks 72 still grasp the bottle neck due to inward pressure applied by the flange 30 on the segments 68.

In the intermediate position described, the membrane liner 79 is no longer pressed over the open end of the bottle 82 in an hermetically sealed manner. This intermediate position, therefore, allows pressurized gas inside the bottle to be liberated or air to enter the bottle to relieve any vacuum, as the case may be. If this gas is, for example, gas present in the container together with a liquid such as a carbonated beverage, the relieved gas passes between the open end of the bottle and the membrane liner overlying it, through slots 70, the channels 80, and the space 96 now defined between the parts 26*a* and 26*b* into the atmosphere. For vacuum relief, the air flow path goes oppositely. The top extremes 90 of the ribs are intended to prevent placement of the cap directly in one motion from the closed position into the open position for safety reasons and for pressure relief reasons. Thus, it is necessary to submit to or undergo a delay, however brief or instantaneous, before effecting the next movement to complete opening of the cap. This delay gives the opportunity needed to relieve the pressure or vacuum inside of the bottle 82.

The intermediate position shown in FIG. 7 is stable. Rotation of the external structure 22 relative to the internal structure 48 while applying a vertical axial pulling force is required to completely open the cap. Only an upward vertical axial pulling while twisting or rotating of the external portion 22 will cause the internal ribs 36 to pass through and traverse the oblique channels 80 in flange 78. Because the intermediate position is secure, possible sudden liberation of the cap by positive pressure contained within the bottle is avoided; the cap is not allowed to be separated from the bottle; and injuries due to sudden or unexpected liberation of the cap are avoided as a result.

The preferred embodiment described has the flange 40 as being continuous and the upstanding arcuate flanges 62 as being separated by slots 64 which extend from the top edges of the flanges 62 downward and terminated short of the bottoms of flanges 62 which are joined together in common. This configuration can be inverted. A permanent groove can be made behind the flange 40 and the flange 40 can be divided into flexible portions similar to the flanges 62. The flanges 62, in this case, could be replaced by a single circular flange. In this construction, the binding action of the single circular flange 62 corresponding to the illustrated flanges 62 would be stiffer and more resistant to bending and, in this way, would help break the perforated safety seal.

Figure 8:
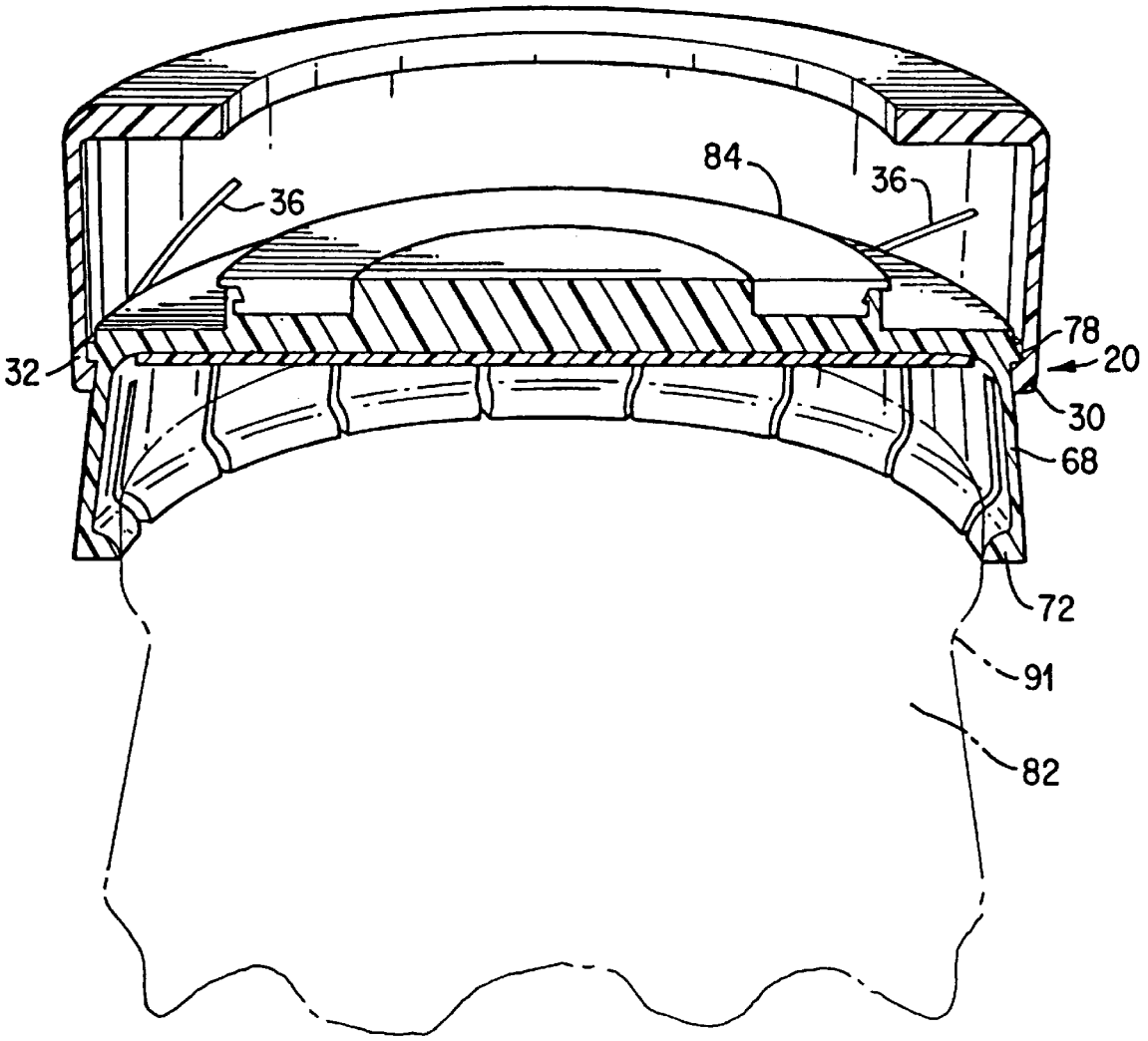
FIG. 8 is a view similar to FIG. 5 but showing the cap in the open position released from the bottle.

Referring now to FIGS. 7 and 8, when the external portion 22 is pulled upwardly and rotated relative to the internal portion 48 of the cap, the internal ribs 36, in appropriate coincidence with the oblique channels 80, will pass through or traverse the flange 78 until the upper surface 32 of the inwardly extending flange 30 contacts the underside of flange 78. At this time, the lowest parts of ribs 36 will still be in channels 80, preloaded or prepositioned for subsequent reclosure. Reclosure can be effected by an inverse movement of external structure 22 relative to internal structure 48, performed by an inversely applied twisting and axial force.

In more detail, to start movement from the intermediate position, represented in FIG. 7, to the open position shown in FIG. 8, the external portion 22 is rotated concurrently with application of an axial force causing the external portion 22 to be pulled upwardly relative to the internal portion 48. As a consequence of the combined rotary and axial forces, the upper extremes 90 of the ribs 36 will be received in the coincident entrances of the channels 80 and drawn into the channels 80 as external structure 22 moves axially relative to internal structure 48. The movement from the intermediate position ends when the ribs 36, except for their lower ends, have passed through the coincident channels 80 and the flange upper surface 32 makes full contact with the underside of the flange 78 of the internal portion 48. FIG. 8 shows the open position in which the binding segments 68 are freed of flange 30 and allowed to flex outwardly, liberating the hooks 72 from the neck of bottle 82. At this time, the cap 20 can be removed from the top of the bottle 82.

After the cap has been placed into the open position shown in FIG. 8, the whole cap is lifted, clearing the mouth of the bottle. Flexing of the cleats defined by the segments 68 is visible in FIG. 8. Flanges 30 and 78 abut in this situation so that the external portion 22 can be lifted and used to pull the internal portion 48 away from the bottle.

Figure 9:
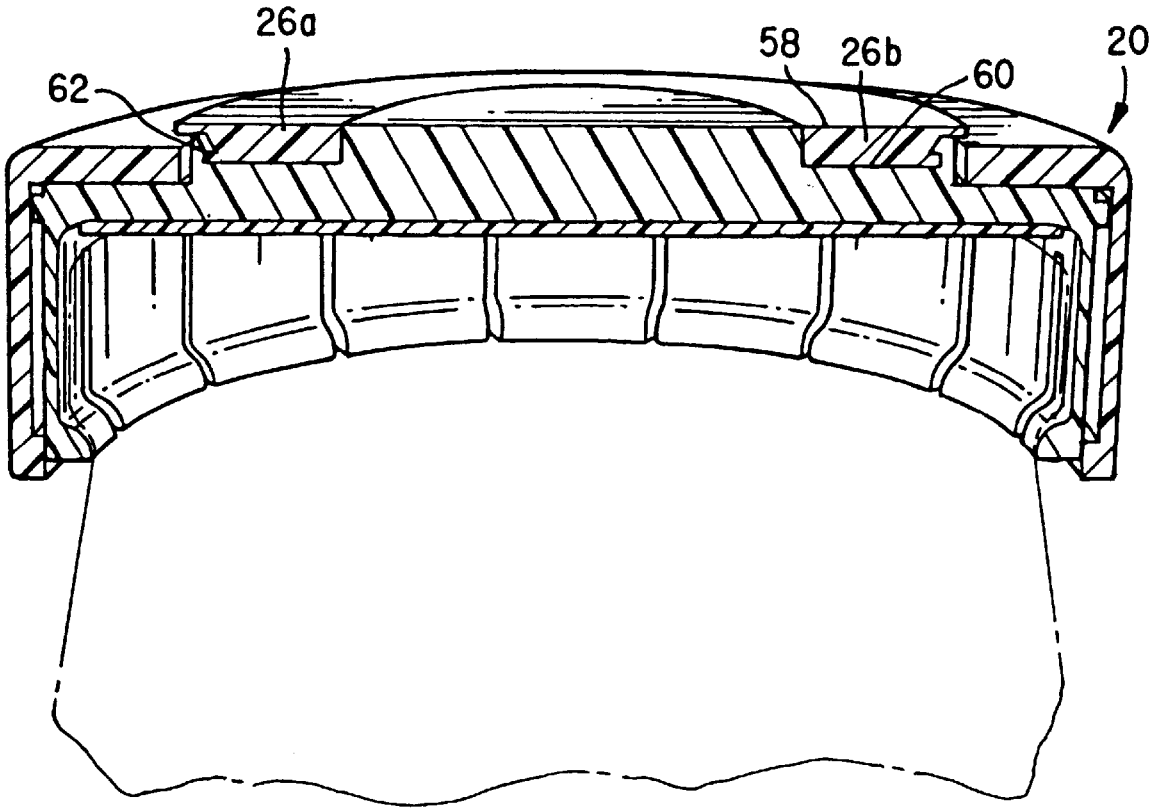
FIG. 9 is a view similar to FIG. 5 but showing the cap in the recapped sealing position clamped to the bottle.

The cap can now be used to recap and again hermetically seal the bottle 82. After breaking the external portion 22 along the breach line 84, the outer annular part 26*b* can slide both upwardly as described previously and downwardly in a recapping movement. FIG. 9 shows the cap 20 in its recapping position with a broken seal. The outer annular part 26*b,* which has separated from the inner annular part 26*a,* now is able to slide downwardly until the third outer annular top surface 60 is reached. The underside of the outer annular part 26*b* rests on the third top surface 60. In this state, tops of the structures 22 and 48 are not coplanar because annular part 26*b* lies slightly lower than annular part 26*a.* Therefore, the flanges 62 are exposed laterally as visual proof of a violation of the safety seal. Tactile evidence is also provided of tampering. More specifically, the third top surface 60 has a level which is below that of the second top surface 58. After the annular parts have been broken away from each other, the outer annular part 26*b* descends during recapping until its underside touches the third top surface 60. Outwardly facing surfaces of the flanges 62 are exposed to view. Tactile evidence, due to the difference in height between the parts 26*a* and 26*b,* is provided when the cap 20 is in the resealed position shown in FIG. 9. Even so, reclosing of the cap forces flanges 72 against the underside of the bead at the top of bottle 82 drawing the cap down and hermetically sealing the liner 79 against the mouth of bottle 82.

According to the construction described, before the safety seal incorporated in the flat annular top 26 of the cap has been violated, the flat annular top is smooth. After the safety seal has been violated, visual and tactile evidence is provided by the displaced top surface levels of the annular parts 26*a* and 26*b.* In the recapping position shown in FIG. 9, the cap maintains its hermetic capabilities. Tamper evidence, however, is noticeable.

Figure 10:
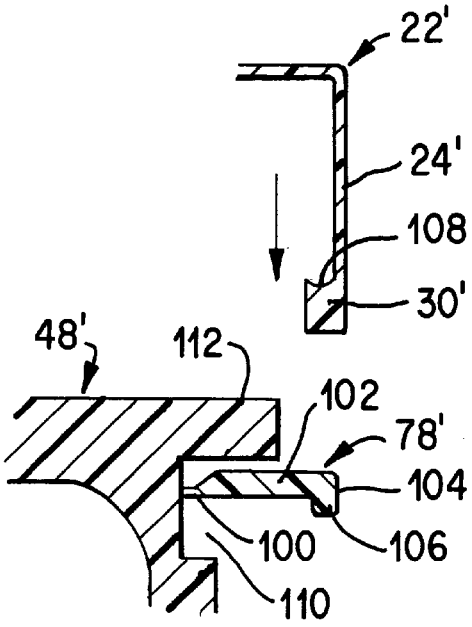
FIGS. 10, 11 and 12 show the operation of a modified structure for facilitating placement of the cap from the insertion or mounting position to the closed position.
Figure 11:
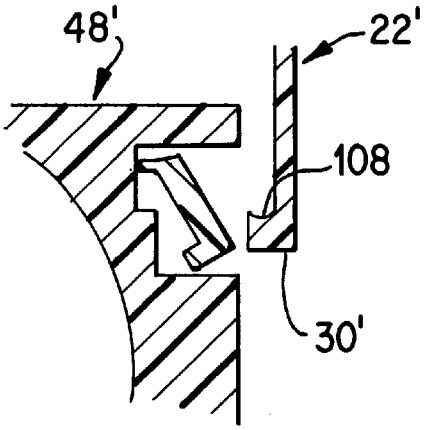
Figure 12:
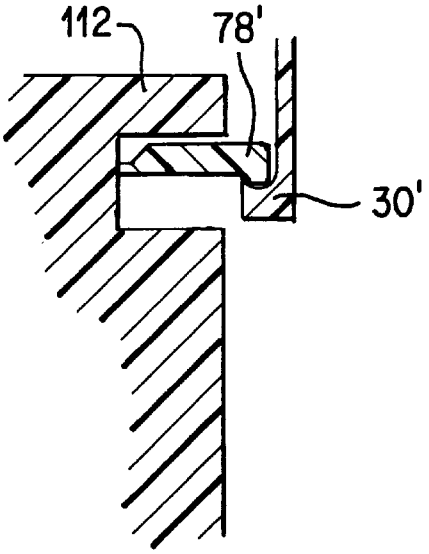

FIGS. 10, 11 and 12 show a modified flange construction for initially joining internal and external cap portions together. The modified flange construction facilitates initial placement of an external structure or portion 22' over an internal structure or portion 48' to arrive at an insertion or mounting position such as that shown in FIG. 5. FIG. 10 shows a modified flange 78' as including an annular portion 100 of reduced thickness that connects flange 78' to the disc-like body. Flange 78' is L-shaped with one leg 102 attached to portion 100 and the other leg 104 facing down and having a rounded free end 106. The external portion 22' is moved downwardly in the direction of the arrow shown in FIG. 10. The flange 30' having a concave upper surface 108 contacts the flange 78' and pivots it downwardly, around the reduced thickness portion 100, into a recess 110 extending about the exterior of the internal portion 48' as shown in FIG. 11. The reduced thickness portion, therefore, acts as a hinge. After the flange 30' has passed by the flange 78', the flange 78' is biased back into its original position by the elasticity of portion 100, and interlocking as shown in FIG. 12 is achieved. The rounded end 106 of downward extending leg 104 on the flange 78' is received in the concave recess 108 defined by the upper surface of the flange 30' to assist in interlocking the external and internal cap portions together. A stop flange 112 is defined on the outer radial periphery of the disc-like body of internal structure 48' to act as a stop for flange 78' in the upward direction as shown in FIG. 12.

The description set out above is not to be considered limiting. Protection for the invention as defined by the following claims, and all equivalents, is sought.

I claim:

1. A cap for a container comprising:

an internal structure and an external structure relatively movable with respect to one another between closed, intermediate and open cap positions;

a first set of elements defined respectively on the internal and external structure and cooperating to lock a selected portion of one of the internal and external structures to the other when the cap is in the closed and intermediate cap positions;

a breakable seal between said selected portion of said one of the internal and external structures and the remainder of said one of the internal and external structures which when broken allows the internal and external structures to move relative to one another in the closed cap position; and a second set of elements defined respectively on the internal and external structures and cooperating to block direct movement of the cap from the closed cap position to the open cap position;

the second set of elements comprising ribs disposed on said external structure receivable in channels defined in said internal structure;

said intermediate cap position being defined by contact between one of said second set of elements and ends of said ribs.

2. A cap as defined in claim 1 wherein said ribs are disposed on said external structure and extend obliquely.

3. A cap as defined in claim 1 wherein visual and tactile evidence that said cap has been moved from said closed cap position is provided.

4. A cap as defined in claim 3 wherein said evidence is provided by a displacement of one part of said external structure relative to another part of said external structure.

5. A cap as defined in claim 4 wherein the parts of said external structure are annular concentric parts.

6. A cap as defined in claim 5 wherein said annular concentric parts are interconnected by said breakable seal, which has a thickness smaller than said annular concentric parts, when said cap is in said closed cap position.

7. A cap as defined in claim 1 wherein said first set of elements comprises complementary flanges defined on said internal and external structures.

8. A combination comprising:

a container having a sealable opening and a cap mounted on the container sealing the opening;

said cap comprising an internal structure and an external structure relatively movable with respect to one another between closed, intermediate and open cap positions;

a first set of elements defined respectively on the internal and external structures and cooperating to lock a selected portion of one of the internal and external structures to the other when the cap is in the closed and intermediate cap positions;

a breakable seal between said selected portion of said one of the internal and external structures and the remainder of said one of the internal and external structures which when broken allows the internal and external structures to move relative to one another in the closed cap position; and a second set of elements defined respectively on the internal and external structures and cooperating to block direct movement of the cap from the closed cap position to the open cap position;

the second set of elements comprising ribs disposed on said external structure receivable in channels defined in said internal structure;

said intermediate cap position being defined by contact between one of said second set of elements and ends of said ribs.

9. The combination as defined in claim 8 wherein both visual and tactile evidence that said cap has been moved from said closed cap position is provided.

10. The combination as defined in claim 9 wherein said evidence is provided by a displacement of one part of said external structure relative to another part of said external structure.

11. The combination as defined in claim 10 wherein the parts of said external structure are annular concentric parts.

12. The combination as defined in claim 11 wherein said annular concentric parts are interconnected by said breakable seal, which has a thickness smaller than said annular concentric parts, when said cap is in said closed cap position.

13. The combination as defined in claim 8 wherein said first set of elements comprises complementary flanges defined on said internal and external structures.

14. The combination as defined in claim 8 wherein said breakable seal includes perforations defining a breach line along which said seal breaks.

* * * * *